US005532799A

United States Patent [19]

Watanabe et al.

[11] Patent Number: 5,532,799

[45] Date of Patent: Jul. 2, 1996

[54] IMAGE FORMING APPARATUS HAVING CONTACT MEMBER CAPABLE OF CONTACTING WITH IMAGE BEARING MEMBER

[75] Inventors: Tsuyoshi Watanabe, Ebina; Hisaaki Senba, Yokohama; Hiroshi Matsumoto; Makoto Yanagida, both of Kawasaki, all of Japan

[73] Assignee: Canon Kabushiki Kaisha, Tokyo, Japan

[21] Appl. No.: 266,305

[22] Filed: Jun. 27, 1994

Related U.S. Application Data

[63] Continuation of Ser. No. 91,035, Jul. 14, 1993, abandoned.

[30] Foreign Application Priority Data

Jul. 16, 1992 [JP] Japan ..... 4-189492

[51] Int. Cl.[6] ..... G03G 15/06; G03G 21/00

[52] U.S. Cl. ..... 355/245; 355/296; 355/210

[58] Field of Search ..... 355/219, 210, 355/245, 251, 259, 271, 273, 296, 299

[56] References Cited

U.S. PATENT DOCUMENTS

| | | | |
|---|---|---|---|
| 4,268,943 | 5/1981 | Watanabe et al. . | |
| 4,819,027 | 4/1989 | Murasaki et al. | 355/253 |
| 4,967,231 | 10/1990 | Hosoya et al. | 355/219 |
| 5,095,335 | 3/1992 | Watanabe et al. | 355/219 X |

*Primary Examiner*—R. L. Moses

*Attorney, Agent, or Firm*—Fitzpatrick, Cella, Harper & Scinto

[57] ABSTRACT

The present invention provides an image forming apparatus with an image forming device for forming a developer image on a recording material, an applicator for applying developer to form an image on an image bearing member to form a developer bearing area. A length of the developer bearing area in the generatrix direction of the image bearing member is longer than a maximum image width on the image bearing member in the generatrix direction thereof.

20 Claims, 4 Drawing Sheets

IMAGE FORMING APPARATUS HAVING CONTACT MEMBER CAPABLE OF CONTACTING WITH IMAGE BEARING MEMBER

This application is a continuation of application Ser. No. 08/091,035, filed Jul. 14, 1993, now abandoned.

BACKGROUND OF THE INVENTION

1. Field of the Invention

The present invention relates to an image forming apparatus such as an electrophotographic copying machine, printer and the like, having a member capable of contacting with an image bearing member.

2. Related Background Art

In the past, it is known to transfer a toner image formed on a rotatable photosensitive drum as an image bearing member onto a sheet-shaped transfer material passing between the photosensitive drum and a transfer roller (contact member) urged against the photosensitive drum. In this case, a voltage having the reverse polarity opposite to the polarity of the toner is applied to the transfer roller to electrostatically attract the toner image to the transfer material.

Normally, the transfer roller is formed from elastic material such as rubber. In this case, however, since the photosensitive drum is directly urged against the transfer roller, the rubber powder of the transfer roller and/or the filler in the rubber adhere to the photosensitive drum. Such materials accumulate in the proximity of a cleaning blade for cleaning the photosensitive drum after the transferring operation and sliding access the surface of the drum. Therefore, such accumulated materials cause damage to the photosensitive drum and generate black stripes and white stripes in the image after several thousand transfer operations. Further, if the printing operations are on transfer materials having a small width in a direction perpendicular to a moving direction of the transfer material are repeated, since areas of the photosensitive drum which are not in contact with the transfer material are always rubbed by the transfer roller, the wear amount of such areas at the position of the cleaning blade is greater than that the area of the photosensitive drum which is in contact with the transfer material. Thereafter, for example, if the printing operation for a large-sized transfer material is performed, there will arise a difference in image density between the areas of the drum which are not in contact with the small-sized transfer materials and the area of the drum which is in contact with the small-Sized transfer materials, thereby creating a poor image.

Further, since the transfer drum urges the transfer material against the photosensitive drum at the zone of the photosensitive drum which is contacted with the transfer material in a generatrix direction of the photosensitive drum, paper powder from the transfer material (paper sheet) adheres to the photosensitive drum and accumulates in the proximity of the cleaning blade. Also if such paper powder rubs against surface of the photosensitive drum, it is feared that the drum is damaged and the black and white stripes are formed in the image.

SUMMARY OF THE INVENTION

An object of the present invention is to provide an image forming apparatus which can prevent the damage of a photosensitive drum.

Another object of the present invention is to provide an image forming apparatus wherein the difference in the eroded amount in the generatrix direction of a photosensitive drum is minimized.

A further object of the present invention is to provide an image forming apparatus which can prevent the occurrence of a poor image such as one with black and white stripes and to form an image with high accuracy.

The other objects and features of the present invention will be apparent from the following descriptions referring to the accompanying drawings.

DETAILED DESCRIPTION OF THE PREFERRED EMBODIMENTS

The present invention will now be explained in connection with embodiments thereof with reference to the accompanying drawings.

Figure 5:
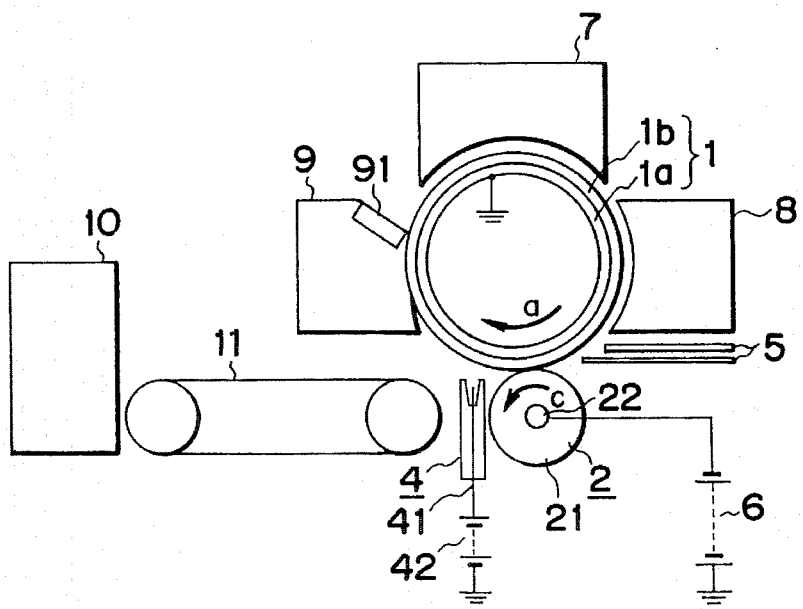
FIG. 5 is a schematic side view of an image forming apparatus of the present invention.

In FIG. 5 showing a schematic side view of an image forming apparatus according to the present invention, a rotatable cylindrical photosensitive drum 1 as an image bearing member can be moved in a direction shown by the arrow a along an endless path and comprises a grounded conductive base body 1*a* and a photosensitive layer 1*b* disposed around the base body 1*a*. After an electrostatic latent image corresponding to image information on an original is formed on the photosensitive drum at an electrostatic latent image forming station 7, the electrostatic latent image is developed with toner as a toner image at a developing station 8. The toner image formed on the photosensitive drum 1 is transferred onto a transfer sheet as a transfer material (paper sheet or the like) at a transfer station. A rotatable transfer roller 2 as a transfer member urged against the photosensitive drum 1 is arranged at the transfer station, so that the transfer sheet is passed through a nip between the photosensitive drum 1 and the transfer roller 2 during the transferring operation. The transfer sheet is fed by a pair of register rollers (not shown) and is guided toward the nip by transfer guides 5. The transfer roller 2 comprises a metal shaft 22, and a conductive sponge rubber roller 21 made of foam material (for example, EPDM i.e., three-dimensional copolymer of ethylene propylene diene) including carbon and mounted on the metal shaft 22. A power source 6 for applying a bias voltage to the transfer roller is connected to the conductive sponge rubber roller 21 via the metal shaft 22. In the illustrated embodiment, since the polarity of the toner (developer) at the developing station 8 is positive, the negative bias voltage is applied to the transfer roller.

A charge removing probe unit 4 serves to remove the charge from the back surface of the transfer sheet to aid the separation of the transfer sheet. A bias applied to the probe unit has the reverse polarity Opposite to the polarity of the transfer bias for the transfer roller to remove the charge from the back surface of the transfer sheet. That is, in this case, a positive bias 42 is applied to a charge removing probe 41 of the probe unit. A convey unit 11 serves to direct the transfer sheet which was separated from the photosensitive drum and to which the toner image was transferred toward a fixing portion 10, where a non-fixed toner image is fixed to the transfer sheet. On the other hand, a cleaning portion 9 serves to remove the residual toner from the photosensitive drum for preparation for the next image formation. The cleaning portion comprises a cleaning blade 91 made of rubber for scraping the residual toner while contacting with the surface of the photosensitive drum 1.

Figure 1:
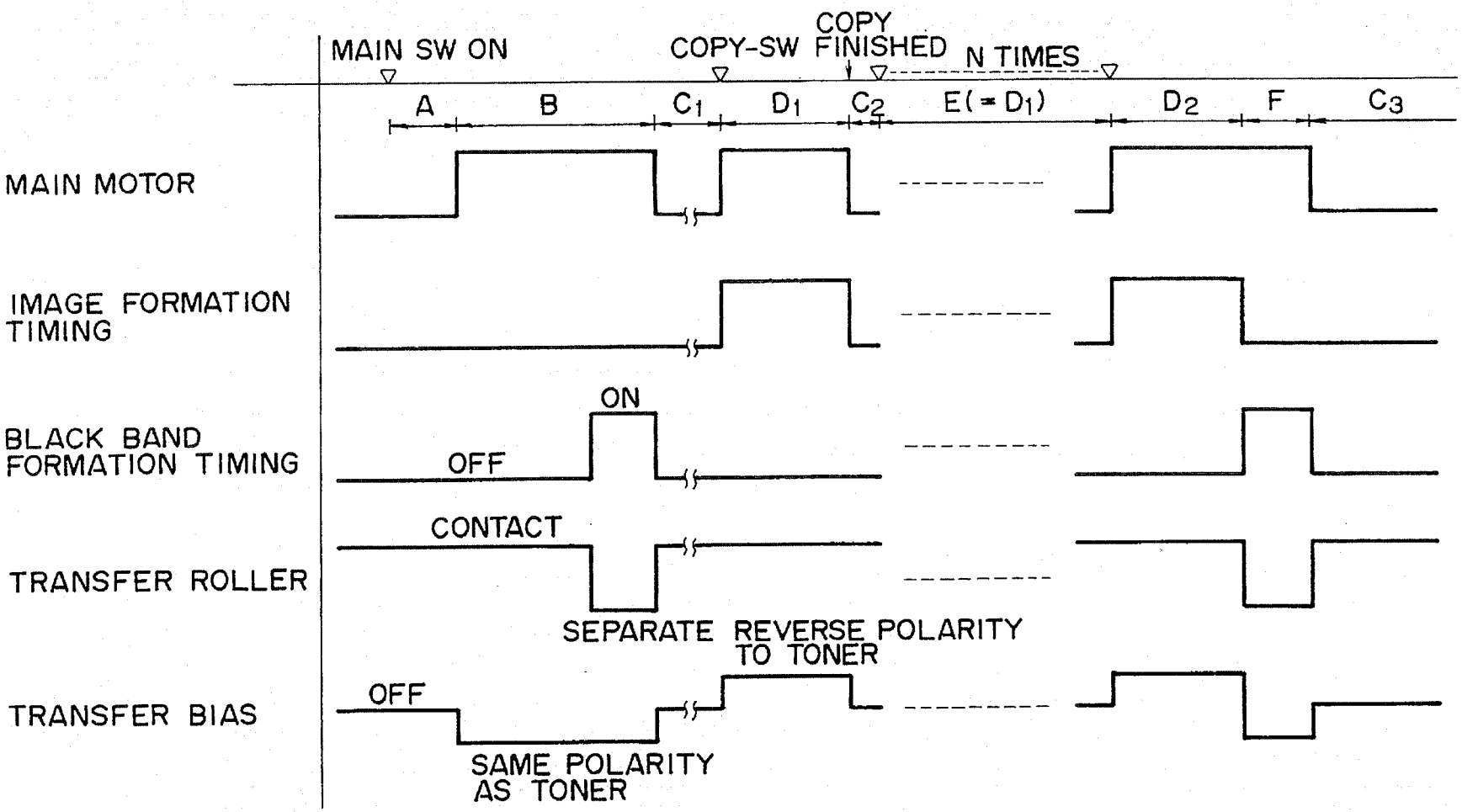
FIG. 1 is a timing chart of an image forming apparatus of the present invention.

The operational sequence (timing chart) of the image forming apparatus is shown in FIG. 1.

When a main power source of the image forming apparatus is turned ON, no operation occurs during an initial time period A. During this time period, the temperature of the fixing portion (not shown) is gradually increased. When the temperature of the fixing portion reaches a certain value, a main motor is driven to rotate a pair of fixing rollers (time period B). This time period B is referred to as a pre-multi-rotation period. When the temperature of the fixing portion reaches a predetermined value, the rotation of the fixing rollers is stopped, thus providing the copy permitting condition (referred to as "stand-by condition") $C_1$.

During the pre-multi-rotation period, there is provided time for applying toner across the entire photosensitive drum extending the longitudinal direction thereof. This timing is referred to as "black band timing". The black band has a length corresponding to the maximum width of the maximum transfer sheet available to the apparatus in the generatrix direction (longitudinal direction), i.e., axial direction of the photosensitive drum and a width of about 10–50 mm (or smaller or more, if necessary) in a rotational direction of the photosensitive drum.

The black band formation occurs at the electrostatic latent image forming station 7 and the developing station 8. For example, in the case of normal development, although a non-image portion (portion on which the toner image is not formed at the developing station in response to any image information) in the moving direction of the photosensitive drum is normally subjected to the light illumination after the primary charge and before the development not to be developed, when it is desired to form the black band, the light illumination is not effected after the primary charge and the development is effected at the developing station. The black band passes through the transfer roller at the transfer station during the non-transfer operation wherein the transfer sheet does not exist, and then reaches the cleaning portion 9 where it is scraped by the blade 91 and gathered in the proximity 93 of the blade. In this case, it is desirable that the gathered toner remains on the whole area of the blade.

Figure 2:
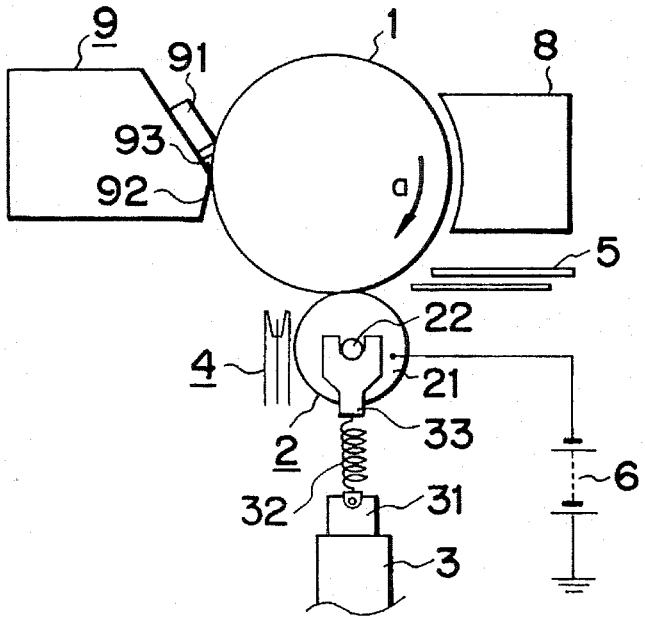
FIG. 2 is a schematic side view of an image forming apparatus of the present invention.

During the normal transferring operation, as shown in FIG. 2, the transfer roller 2 is urged against the photosensitive drum 1 by lifting the metal shaft 22 by a spring 32 via a plastic arm 33. In this case, the bias voltage having the polarity opposite to that of the toner is applied to the transfer roller from the power source 6.

Figure 3:
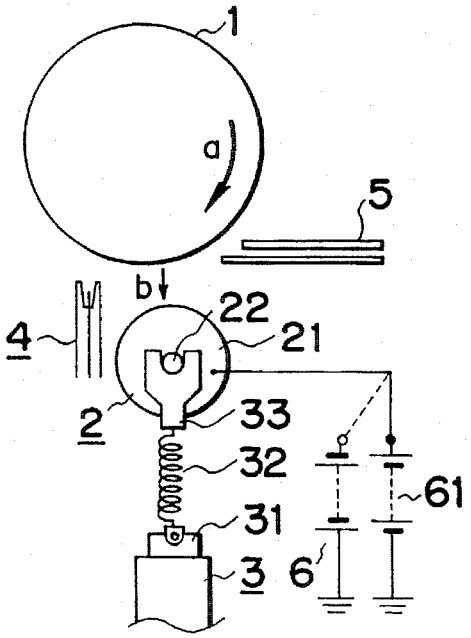
FIG. 3 is a side view showing a condition that a photosensitive drum is separated from a transfer drum.

However, during the black band formation, since the toner exists on the photosensitive drum 1, if the transfer roller contacts the photosensitive drum, the toner may adhere to the transfer roller, thus contaminating it. If the surface of the transfer roller is smudged with toner, the toner will adhere to the back surface of the transfer sheet, thus causing a poor copy. To avoid this, during the black band formation, as shown in FIG. 3, at the same time as when the black band passes through the transfer station, the transfer roller 2 must be separated from the photosensitive drum 1. The separation of the transfer roller 2 is effected by energizing a solenoid 3 to shift an iron core 31 in a direction shown by the arrow b. The separating distance or space between the photosensitive drum 1 and the transfer roller 2 may be several millimeters. The separation distance of the roller 2 may be selected as small as possible to prevent the vibration. Particularly, when the separation distance is smaller than 5 mm, as shown in FIG. 3, by switching to a power source 61, the bias having a polarity (positive) the same as that of the toner may be applied to the transfer roller 2 so that the transfer roller is more effectively prevented from being contaminated due to the repulsion between the toner and the transfer roller. The reason is that, even when the separation distance is 5 mm, if the bias having the polarity opposite to that of the toner is applied to the transfer roller 2, the toner may be flying toward the surface of the transfer roller due to the electric field generated by the application of the bias.

In the illustrated embodiment, while the power source 61 has a polarity the same as that of the toner, the transfer roller 2 may be electrically floated or may be earthed via an impedance element such as a high resistor to achieve the above-mentioned effect, i.e., to prevent the transfer roller from smudging, since the electric field is not generated or considerably weakened.

When the above-mentioned black band is not formed, a portion of the photosensitive drum through which the transfer sheet passes is damaged to generate black and white stripes. That is, the paper powder (more concretely, paper fibers) from the transfer sheet (paper sheet) and various additives in the paper are adhered to the photosensitive drum because the transfer sheet is urged against the drum by the transfer roller, and are then gathered in the proximity 93 of the blade 91 as the drum is rotated, with the result that the photosensitive drum is scratched by the gathered foreign matters to damage the former. The reason is that the additives or fillers include hard materials such as $CaCo_3$, $TiO_2$, kaolin or the like. Further, the reason why the paper powder and the like are likely to adhere to the drum in comparison with a conventional corona transfer charger having a wire electrode and a shield electrode is that the transfer paper is strongly urged against the photosensitive drum by the transfer roller 2.

To the contrary, in the corona transfer, the transfer sheet is lightly contacted with the photosensitive drum by the resilience of the sheet itself. Accordingly, when the black band is formed, since the toner is gathered in the proximity 93 of the blade 91, the accumulation of paper powder and the like can be prevented. If a small amount of the paper powder and the like remains in the proximity of the blade, since such paper powder is mixed with a large amount of toner to increase the lubricating ability, the inconvenience due to the accumulated paper powder will be minimized. That is, when the paper powder is mixed with the large amount of toner, since the photosensitive drum is uniformly rubbed by the paper powder in the proximity 93 of the blade, the drum is not damaged. Incidentally, even when the black band is not formed, although the residual toner (remaining on the drum after the transferring operation) also accumulates in the proximity of the blade, since an amount of the residual toner is small, the above effect cannot be expected.

Further, as mentioned above, portions of the photosensitive drum (in the longitudial direction thereof) through which the transfer sheet is not passed are damaged or rubbed to generate the abrasion irregularity. This is fully explained hereinbelow.

When the transfer sheet is not passed through the transfer station and the photosensitive drum 1 is always contacted with the transfer roller 2, the inconvenience due to the paper powder does not occur. However, since the transfer roller 2 is formed from the elastic material such as rubber, the rubber powder from the transfer roller and the fillers in the rubber adhere to the photosensitive drum 1, with the result that such rubber powder and the like are gathered in the proximity 93 of the blade, thereby slidingly rubbing the surface of the drum. Therefore, similar to the above, the drum is damaged and the difference in the erosion amount of the drum is generated due to the existence of the foreign matters such as the rubber powder and the like (different from the paper powder). That is, there arises the difference in the thickness of the drum (thickness of the photosensitive layer) between the transfer sheet passing area and the sheet non-passing area of the drum. When such difference arises, the potential in the bright area and the potential in the dark area are varied. As a result, after the images are successively formed on a relatively large number of small-sized transfer sheets (having a smaller width in the longitudinal direction of the drum), when the image is formed on the maximum size transfer sheet, since the image density and the fog condition are differentiated between the previous sheet passing area and the previous sheet non-passing area, the poor image is formed.

In this case, when the black band is formed, since the toner uniformly remains along the longitudinal direction of the drum in the proximity 93 of the blade, the accumulation of the paper powder in the sheet passing area and the gathering of the rubber powder and fillers in the sheet non-passing area can be prevented. Further, similar to the paper powder, if a small amount of rubber powder accumulates, since such rubber powder is mixed with a large amount of toner, the inconvenience due to the presence of rubber powder can be minimized.

In the illustrated embodiment, referring to a center of the photosensitive drum in the generatrix direction thereof as a reference position, a maximum image width (a maximum width where the image can be formed in response to any image information) was 292 mm, a maximum length of the maximum transfer sheet available to the image forming apparatus was 297 mm, a length of the black band was 300 mm, a contacting line length which corresponds to the width of the developer bearing area between the transfer roller and the photosensitive drum was 307 mm and a contacting line length between the cleaning blade and the photosensitive drum was 320 mm. That is to say, as shown in FIG. 6, a relation (maximum image width)<(maximum sheet size length)<(black band length)<(contact length between the transfer roller and the photosensitive drum)<(contact length between the cleaning blade and the photosensitive drum) is maintained.

The reason why the maximum sheet size length is smaller than the black band length is that, since the paper powder is greatly generated particularly from both ends of the transfer paper, the black band is extended beyond positions corresponding to the both ends of the transfer paper, thereby preventing the damage of the drum at these positions. Incidentally, since these positions are situated out of the image width, although the damage of the drum at these portions does not affect a bad influence upon the image immediately, the damage to the drum gradually extends inward to reach the inside of the image width. The extension of the damage of the drum will be 3–4 mm. Therefore, it is desirable that the maximum sheet size length is smaller than the black band length. Incidentally, although the maximum image width differs from the black band length, this can be adjusted by adjusting the width of the light illumination to the end zones of the photosensitive drum after the primary charge and before the development.

On the other hand, the reason why the black band length is smaller than the contact length between the transfer roller and the photosensitive drum is that, although contaminants such as rubber powder from the transfer roller are also generated from the black band, since these positions are situated spaced outwardly far from the image width, if the drum is damaged at these positions, the damage of the drum does not adversely affect the image width. It is preferable that a distance between the end of the maximum image width and the end of the black band is 4 mm or more. Incidentally, regardless of the size of the available transfer sheet, an area in which the black band is formed always exists between the end of the transfer sheet and the end of the transfer roller contacting with the drum. However, in order to surely prevent the poor image due to the existence of contaminants generated from the transfer roller, it is desirable that the black band length is greater than the contact length between the transfer roller and the photosensitive drum.

Figure 6:
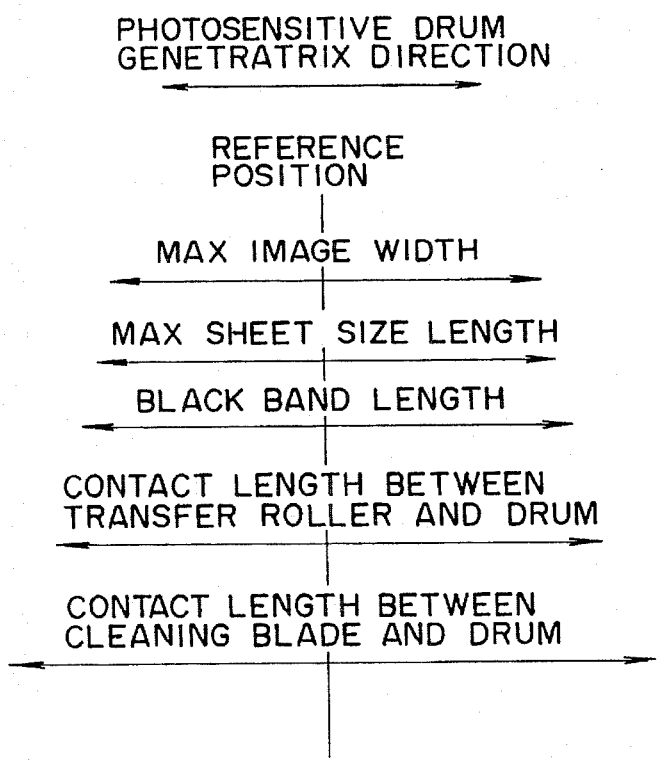
FIG. 6 is an explanatory view showing lengths of various parameters in a generatrix direction of a photosensitive drum.

Further, in FIG. 6, the reason why the contact length between the cleaning blade and the photosensitive drum is greatest is that the toner, paper powder, rubber powder and the like can be completely removed after the cleaning operation.

As mentioned above, by uniformly retaining the toner in the proximity 93 of the cleaning blade 91, the inconvenience due to the paper powder and the like in the sheet passing area and the inconvenience due to the rubber powder and the like in the sheet non-passing area can be avoided very effectively.

Now, the timing for forming the black band will be explained with reference to FIG. 1.

After the main power source is turned ON, during the pre-multi-rotation period B, the black band forming timing is started. After the stand-by period $C_1$, the image is formed and copied during a copying operation period $D_1$. In this period, the black band formation and the separation of the transfer roller are not effected. After the copying operation, a stand-by period $C_2$ is reestablished. Normally, the copying operations are repeated by an operator in this way. However, if the copying operation is continued for a long time without the black band formation, since the retained toner is gradually decreased, the above-mentioned inconvenience or problem will arise. Although ON/OFF of the main power source may be repeated, the operator does not know its timing. Accordingly, it is preferable that the separation of the transfer roller is effected simultaneously with the black band formation after a copying period $D_2$ in which a predetermined number of copies are formed.

Test 1

After the main power source is turned ON, the black band is formed. Then, each time 100 copies are formed, the black band formation and the separation of the transfer roller are repeated, during which the bias having the reverse polarity opposite to the polarity of the toner is applied to the transfer roller. In this condition, when the intermittent copying operations were repeated regarding 30,000 small-sized transfer sheet, the excellent images were obtained.

Test 2

Each time 50 copies were formed, the black band formation and the separation of the transfer roller were repeated, during which the transfer roller was grounded via the high resistor. As a result, it was found that the same effect as the Test 1 was achieved.

Figure 4:
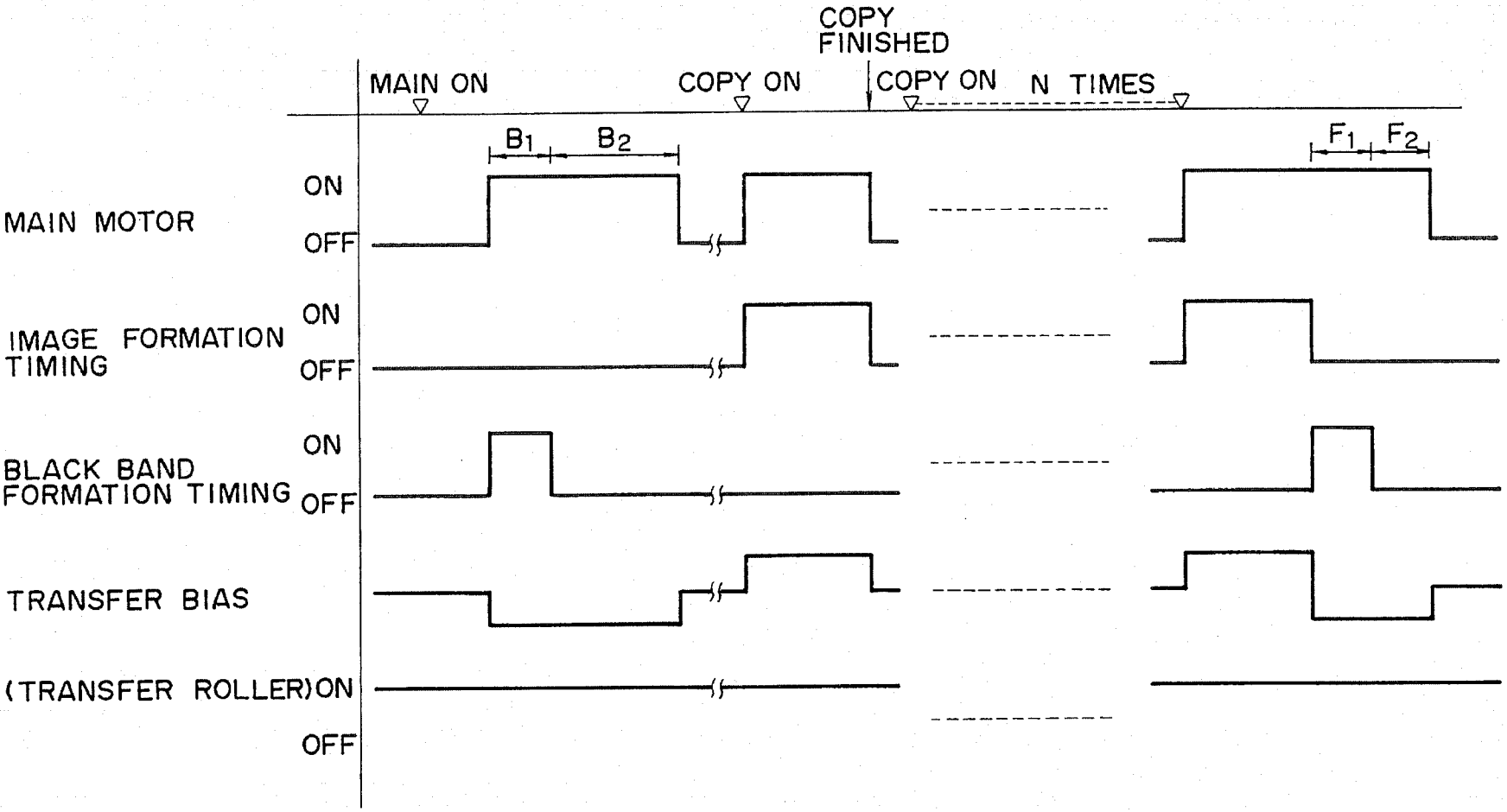
FIG. 4 is a timing chart of an image forming apparatus of the present invention.

Next, an operational sequence of an image forming apparatus according to another embodiment will be explained with reference to FIG. 4. In this embodiment, the transfer roller 2 is not separated from the drum 1 so that the transfer roller is always maintained in a condition shown in FIG. 5.

After the main power source is turned ON, during the pre-multi rotation period $B_1$, the black band is formed. In this case, the toner is retained on the photosensitive drum 1, and, when the black band reaches the transfer station, the transfer roller 2 is still in contact with the drum 1. At this point, a bias having the polarity same as that of the toner is applied to the transfer roller 2. In this case, it is necessary to apply the bias stronger than the above-mentioned bias applied during the separation of the transfer roller from the drum. As an example, when a volume resistance value of the conductive sponge roller on the metal shaft of the transfer roller is $10^7$ Ω.cm, the bias voltage of 2.0–3.0 KV having the polarity same as that of the toner is applied to the transfer roller. This strong reverse electric field prevents the toner from adhering to the transfer roller 2. However, since the toner is urged against the transfer roller, a small amount of toner will be adhered to the roller. Thereafter, during a period $B_2$ after the black band formation has been completed, the cleaning bias (having the same polarity as that of the toner) continues to be applied to the transfer roller. This reverse electric field causes the toner on the transfer roller to return onto the photosensitive drum during the period $B_2$.

Further, after N (in number) copies are obtained, during a period $F_1$, the black band forming timing and the transfer cleaning bias (having the same polarity as that of the toner) are activated. During a period $F_2$, only the transfer cleaning bias (having the same polarity as that of the toner) continues to be applied.

In this embodiment, substantially the same effect as the first embodiment can be achieved, without the separation of the transfer roller from the drum.

On the other hand, in the sequence shown in FIG. 1, the transfer roller 2 may be urged against the photosensitive drum only during the image formation timing (i.e., when the transfer sheet exists in the transfer station) and may be separated from the drum otherwise. In this case, since the transfer roller 2 is urged against the photosensitive drum 1 only when necessary, the wear and deterioration of the photosensitive drum can be minimized.

The present invention is not limited to the above embodiments, and various alterations can be effected within the scope of the present invention.

What is claimed is:

1. An image forming apparatus, comprising:

image forming means for forming an image on a recording material, said image forming means having an image bearing member for bearing a developer image thereon and a contact member contactable with said image bearing member for image formation;

application means for applying developer to the image bearing member to form a developer bearing area thereon, the developer bearing area being formed in an area not contacting the recording material and extending in a generatrix direction of the image bearing member; and a cleaning member contacting with the developer bearing area of the image bearing member for cleaning the developer thereon, wherein a width of said developer bearing area on said image bearing member is wider than a maximum image width on said image bearing member in the generatrix direction thereof.

2. An image forming apparatus according to claim 1, wherein said contact member comprises a transfer member contactable with a back surface of the recording material to transfer the image from said image bearing member onto the recording material.

3. An image forming apparatus according to claim 2, wherein the width of said developer bearing area in said generatrix direction is wider than a maximum width of the recording material in said generatrix direction.

4. An image forming apparatus according to claim 1, wherein a contact width between said image bearing member and said contact member in said generatrix direction is wider than the width of said developer bearing area in said generatrix direction.

5. An image forming apparatus according to claim 3, wherein a contact width between said image bearing member and said contact member in said generatrix direction is wider than the width of said developer bearing area in said generatrix direction.

6. An image forming apparatus according to claim 4, wherein a contact width between said image bearing member and said cleaning member in said generatrix direction is wider than the contact width between said image bearing member and said contact member in said generatrix direction.

7. An image forming apparatus according to claim 1, wherein, after said developer bearing area passes through a contact position between said image bearing member and said contact member, said contact member is separated from said image bearing member.

8. An image forming apparatus according to claim 1, wherein, when said developer bearing area passes through a contact position between said image bearing member and said contact member, a voltage having the polarity same as the polarity of the developer is applied to said contact member.

9. An image forming apparatus according to claim 7, wherein, when said developer bearing area passes through a contact position between said image bearing member and said contact member, a voltage having the polarity same as the polarity of the developer is applied to said contact member.

10. An image forming apparatus according to one of claims 1 to 9, wherein a contacting width between said image bearing member and said cleaning member in the generatrix direction is wider than a width of the developer bearing area in the generatrix direction.

11. An image forming apparatus, comprising:

image forming means for applying developer to form an image on a recording material, said image forming means having an image bearing member and a contact member contactable with said image bearing member; and application means for applying the developer to said image bearing member to form a developer bearing area on said image bearing member extending in a generatrix direction thereof, wherein a width of said developer bearing area in the generatrix direction of said image bearing member is wider than a contact width between said image bearing member and said contact member in said generatrix direction.

12. An image forming apparatus according to claim 11, wherein said contact member comprises a transfer member contactable with a back surface of the recording material to transfer the image from said image bearing member onto the recording material.

13. An image forming apparatus according to claim 11, wherein the width of said developer bearing area in said generatrix direction is wider than a maximum image width on said image bearing member in said generatrix direction.

14. An image forming apparatus according to claim 12, wherein the width of said developer bearing area in said generatrix direction is wider than a maximum width of the recording material in said generatrix direction.

15. An image forming apparatus according to claim 11, further comprising a cleaning member contacting with said image bearing member to clean said image bearing member, and wherein a contact width between said image bearing member and said cleaning member in said generatrix direction is wider than the width of said developer bearing area in said generatrix direction.

16. An image forming apparatus according to claim 11, wherein, when said developer bearing area passes through a contact position between said image bearing member and said contact member, said contact member is separated from said image bearing member.

17. An image forming apparatus according to claim 11, wherein, when said developer bearing area passes through a contact position between said image bearing member and said contact member, a voltage having the polarity same as the polarity of the developer is applied to said contact member.

18. An image forming apparatus according to claim 16, wherein, when said developer bearing area passes through a contact position between said image bearing member and said contact member, a voltage having the polarity same as the polarity of the developer is applied to said contact member.

19. An image forming apparatus according to claim 11, further comprising a cleaning member for cleaning the image bearing member, said cleaning member contacting the image bearing member so that the developer on the developer bearing area is cleaned by said cleaning member without contacting the recording material.

20. An image bearing apparatus according to one of claims 1 to 11, wherein said contact member has a rubber layer contactable with said image bearing member.

* * * * *

UNITED STATES PATENT AND TRADEMARK OFFICE

CERTIFICATE OF CORRECTION

PATENT NO. : 5,532,799
DATED : July 2, 1996
INVENTOR(S) : TSUYOSHI WATANABE, ET AL.

It is certified that error appears in the above-indentified patent and that said Letters Patent is hereby corrected as shown below:

Column 1,
line 33, "access" should read --across--;
line 43, "that" should read --that of--; and
line 56, "the" should be deleted.

Signed and Sealed this

Twenty-ninth Day of October 1996

*Attest:*

BRUCE LEHMAN

*Attesting Officer*

*Commissioner of Patents and Trademarks*